US010179885B2

(12) United States Patent
Pierre et al.

(10) Patent No.: US 10,179,885 B2
(45) Date of Patent: Jan. 15, 2019

(54) DISPERSANT SUITABLE FOR LUBRICANT FORMULATIONS

(71) Applicant: DOW GLOBAL TECHNOLOGIES LLC, Midland, MI (US)

(72) Inventors: Cynthia Pierre, Naperville, IL (US); Edward D. Daugs, Midland, MI (US); Paul R. Elowe, Arcadia, CA (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/124,871

(22) PCT Filed: Mar. 18, 2015

(86) PCT No.: PCT/US2015/021134
§ 371 (c)(1),
(2) Date: Sep. 9, 2016

(87) PCT Pub. No.: WO2015/148192
PCT Pub. Date: Oct. 1, 2015

(65) Prior Publication Data

US 2017/0073603 A1 Mar. 16, 2017

Related U.S. Application Data

(60) Provisional application No. 61/970,926, filed on Mar. 27, 2014.

(51) Int. Cl.

| | |
|---|---|
| ***C10M 159/12*** | (2006.01) |
| ***C10M 133/06*** | (2006.01) |
| ***B01D 19/04*** | (2006.01) |
| ***C10L 1/22*** | (2006.01) |
| ***C10M 133/40*** | (2006.01) |
| ***C10M 133/08*** | (2006.01) |
| ***C10M 133/10*** | (2006.01) |
| ***C10M 133/14*** | (2006.01) |

(52) U.S. Cl.
CPC ..... *C10M 133/40* (2013.01); *C10M 133/08* (2013.01); *C10M 133/10* (2013.01); *C10M 133/14* (2013.01); *C10M 2215/042* (2013.01); *C10M 2215/044* (2013.01); *C10M 2215/221* (2013.01); *C10N 2220/021* (2013.01); *C10N 2230/04* (2013.01); *C10N 2240/10* (2013.01)

(58) Field of Classification Search
CPC ..... C10M 133/54; C10M 129/18; C10M 2217/022
USPC ..... 508/543, 545, 560
See application file for complete search history.

(56) References Cited

U.S. PATENT DOCUMENTS

| | | | | |
|---|---|---|---|---|
| 2005/0020735 | A1 | 1/2005 | Krappe et al. | |
| 2006/0089426 | A1* | 4/2006 | Haubennestel | C08G 59/184 523/404 |
| 2011/0301068 | A1* | 12/2011 | Cocco | C10M 139/00 508/175 |
| 2013/0237641 | A1* | 9/2013 | Riff | B01D 17/047 523/414 |
| 2015/0080278 | A1 | 3/2015 | Terada et al. | |
| 2015/0105523 | A1 | 4/2015 | Gan et al. | |

FOREIGN PATENT DOCUMENTS

| | | |
|---|---|---|
| DE | 3623297 | 1/1988 |

OTHER PUBLICATIONS

International Search Report & Written Opinion for related PCT Application PCT/US2015/021134, dated Jun. 16, 2015 (10 pgs).
International Preliminary Report on Patentability for related PCT Application PCT/US2015/021134, dated Oct. 6, 2016 (7 pgs).

* cited by examiner

*Primary Examiner* — Prem C Singh
*Assistant Examiner* — Frank C Campanell
(74) *Attorney, Agent, or Firm* — Brooks, Cameron & Huebsch, PLLC

(57) ABSTRACT

A dispersant includes the reaction product of an amine and at least one equivalent of glycidyl ether where the amine is selected from a group consisting of aminoethylpiperazine, bis(2-(piperazin-1-yl)ethyl)amine, 4,4'-methylenebiscyclohexylamine, m-xylenediamine, diethylenetriamine, and triethylenetetramine and where the glycidyl ether has the structure (A), where R is selected from aromatic carbon chains, non-aromatic carbon chains and polyalkylene glycol groups. The dispersant is useful in a lubricant with a base oil for increasing soot dispersibility of the lubricant.

(A)

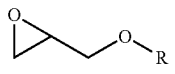

8 Claims, No Drawings

DISPERSANT SUITABLE FOR LUBRICANT FORMULATIONS

BACKGROUND OF THE INVENTION

Field of the Invention

The present invention relates to a dispersant that is a reaction product of an amine and a glycidyl ether.

Introduction

Modern lubricants find use in a wide variety of applications. Lubricants can have various functions, including controlling friction between surfaces of moving parts, reducing wear of moving parts, reducing corrosion of surfaces of moving parts, particularly metal surfaces, damping mechanical shock in gears, and forming a seal on the walls of engine cylinders. A lubricant composition contains a base oil and typically one or more additives or modifiers that provide additional performance properties to the lubricant composition.

Soot or sludge formation is a widely encountered problem with many lubricants, particularly those that are used in fuel burning internal combustion engines, such as automotive engines, marine engines, railroad engines, power plant diesels, and the like. Soot is formed from incomplete combustion in engine and exhaust systems. Soot particles can lead to an increase in the viscosity of the lubricant, deposition of contaminants onto metal surfaces, and soot induced wear. Thus, control of soot is an important performance attribute for lubricants used in fuel burning engines.

Soot control may generally be provided through inclusion of dispersants, detergents, or both in the lubricant. Dispersants suspend soot and similar contaminants in the bulk oil, thereby preventing an increase in engine oil (lubricant) viscosity. Detergents are primarily designed to neutralize combustion products; through neutralization of those species, detergents inhibit rust and corrosion and high temperature deposits.

Conventional dispersants and detergents are often lacking for a number of reasons, including the inability to provide the desired performance properties, processing problems, overall performance per cost, or the inability to optimize properties based on specific end-use performance characteristics. For example, viscometrics and low temperature properties are important variables in the final product, and dispersants and detergents with broader flexibility offer processing advantages to the formulator. Additionally, many dispersants were developed for hydrocarbon based lubricants and show incompatibility with polyalkylene glycol base oils due to their low solubility in polyalkylene glycols.

The problem addressed by this invention is the provision of new compositions that are useful as dispersants and/or detergent additives for engine lubricants. It is known that amine alkoxylate compositions having the following structure can be effective dispersants for engine lubricants:

(I)

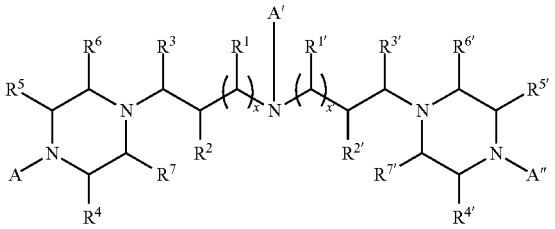

where $R^1$-$R^7$ and $R^{1'}$-$R^{7'}$ are independently hydrogen or hydrocarbyl groups, x and x' are independently 0 or an integer in the range of 1-10.

Yet, it is desirable to find an even more effective dispersant additive for engine lubricants.

BRIEF SUMMARY OF THE INVENTION

The present invention provides a dispersant for engine lubricants that can be a more effective dispersant that the amine alkoxylate compositions of formula (I).

The present invention is a result of surprisingly discovering that reacting certain amines having at least three active hydrogen atoms (that is, hydrogen atoms on amines that will react with a glycidyl functionality) with at least an equivalent of glycidyl ether can produce a more effective dispersant for engine lubricants than the alkoxylate composition of formula (I). Without being bound by theory, the resulting beta hydroxyl functionalities relative to the amines are thought to enhance binding of the dispersant to soot.

It was further discovered that not all amines having at least three active hydrogen atoms will produce quality dispersants for engine lubricants. It is an additional discovery that the amine must have a structure sufficient to allow capture of the soot particles. Hence, the certain amines from which the dispersants of the present invention are prepared are selected from a group consisting of aminoethylpiperazine, bis(2-(piperazin-1-yl)ethyl)amine, 4,4'-methylenebiscyclohexylamine, m-xylenediamine, diethylenetriamine, and triethylenetetramine.

The choice of glycidyl ether depends on the character of base oil in the engine lubricant in which the dispersant shall be used. For instance, alkyl chains are desirable for mineral oil lubricants and polyalkylene glycol chains are desirable for polyalkylene glycol lubricants.

The present invention is useful as a dispersant in engine oil.

In a first aspect, the present invention is a dispersant comprising the reaction product of an amine and at least one equivalent of glycidyl ether where the amine is selected from a group consisting of aminoethylpiperazine, bis(2-(piperazin-1-yl)ethyl)amine, 4,4'-methylenebiscyclohexylamine, m-xylenediamine, diethylenetriamine, and triethylenetetramine and where the glycidyl ether has the following structure:

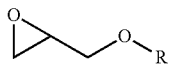

where R is selected from aromatic carbon chains, non-aromatic carbon chains and polyalkylene glycol groups.

In a second aspect, the present invention is a lubricant comprising a base oil and the dispersant of the first aspect.

In a third aspect, the present invention is a method for increasing soot dispersibility of a lubricating fluid, the method comprising adding to the lubricating fluid the dispersant of the first aspect.

In a second aspect, the present invention is a lubricant comprising a base oil and the dispersant of the first aspect.

In a third aspect, the present invention is a method for increasing soot dispersibility in a lubricating fluid comprising adding to the lubricating fluid the dispersant of the first aspect.

DETAILED DESCRIPTION OF THE INVENTION

All ranges include endpoints unless otherwise stated. "And/or" means "and, or alternatively". "Miscible" means able to be mixed together at a molecular level.

"Mw" refers to weight average molecular weight and "Mn" refers to number average molecular weight. Determine molecular weight values and conduct molecular weight analysis herein using gel permeation chromatography (GPC). Conduct GPC analysis using an Agilent 1100 Series GPC by dissolving 0.10 grams of sample in 10 milliliters of tetrahydrofuran (THF) and inject 50 microliters of the resulting solution onto a series of two Polymer Labs PLgel 5 micrometer MIXED-E columns (330×7.5 millimeter) and elute with THF at a flow rate of 1.0 milliliters per minute at 35 degrees Celsius (° C.). Use a conventional calibration curve generated using narrow polyethylene glycol standards for quantitation.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institute für Normung; and ISO refers to International Organization for Standards.

The present invention is a dispersant comprising the reaction product of an amine and at least one equivalent of a glycidyl ether. An equivalent of glycidyl ether means there is one glycidyl ether molecule present for each hydrogen-nitrogen amine bond in the mixture of amine and glycidyl ether. A hydrogen atom bound to nitrogen in an amine is considered a "reactive hydrogen" because of its propensity to react with a glycidyl ether. It is important for the reaction to be run with at least an equivalent of a glycidyl ether, preferably an excess of glycidyl ether, to maximize the likelihood that each reactive hydrogen of each amine reacts with glycidyl ether.

The amine is selected from a group consisting of aminoethylpiperazine, bis(2-(piperazin-1-yl)ethyl)amine, 4,4'-methylenebiscyclohexylamine, m-xylenediamine, diethylenetriamine, and triethylenetetramine. It has surprisingly been discovered that these particular amines have the necessary number of reactive hydrogens and have those reactive hydrogens properly spaced so that reacting the amine with at least an equivalent of a glycidyl ether produces a dispersant that is particularly efficient at dispersing soot molecules. Without being bound by theory, it is believed that the resulting dispersant has a particularly effective number of and spacing of important functionalities for binding with soot particles. The important functionalities for binding to soot particles are believed to be the beta-hydroxyl groups and amine nitrogen atoms in the resulting dispersant.

The amines listed above have proven to provide such an appropriate spacing whereas other amines having similar numbers of reactive hydrogens but spaced differently have not proven to produce similarly effective dispersants. For example, the following amines have not proven to produce particularly effective dispersants when reacted with at least an equivalent of glycidyl ether: benzylamine, 1,5-diaminonaphthalene, dibenzylamine, 4,4'-diaminodiphenylmethane, and N, N-dibenzylethylenediamine.

The dispersant is a reaction product of the amine with glycidyl ether. The reaction product has a beta-hydroxyl group relative to the amine nitrogen. It is believed that the beta hydroxyl group helps bind the dispersant to soot particles thereby enhancing dispersing capability of the dispersant.

The glycidyl ether has the following structure:

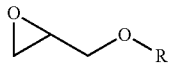

where R is selected from aromatic, non-aromatic and polyalkylene glycol groups. Select the R group to be compatible with a base oil into which the dispersant is intended for use. A group is "compatible" with a material if it is miscible with that material. For example, if the dispersant is for use in a hydrocarbon base oil then select a hydrocarbon or hydrocarbon compatible R group. For polyalkylene glycol base oils it is desirable for R to be selected from polyalkylene glycol groups. Additionally, in order for the dispersant to be effective, the R-group needs to be able to effectively suspend a bound soot particle to in the fluid matrix. For polyalkylene glycol base oils, this is attained by use of a polyalkylene glycol R group with a number average molecular weight (Mn) of greater than 500 grams per mole.

The dispersant of the present invention is particularly desirable for use in polyalkylene glycol (PAG) base oils, in which case the R on the glycidyl ether component is desirably selected from PAG groups. Lubricants comprising PAG base oils are growing in popularity due to their advantaged viscometrics and longer use lifetimes relative to natural hydrocarbon base oils in combustion engine lubricant applications. However, soot produced in combustion engines needs to be dispersed in the lubricant or the lifetime of the lubricant becomes shortened as soot builds up and agglomerates. Stable and effective soot dispersants for PAG based oils have been a challenge to identify. Yet the present invention provides highly effective dispersants that are suitable for use in lubricants comprising PAG base oil. One desirable glycidyl ether has an R group that is selected from poly(propylene glycol) alkyl ethers, preferably poly(propylene glycol) methyl ether. The poly(propylene glycol) alkyl ether desirably has a number average molecular weight (Mn) of 500 grams per mole or more (g/mol), preferably 800 g/mol or more and more preferably 1000 g/mol or more and can be 1100 g/mol or more and even 1200 g/mol or more while at the same time typically has a Mn of 5000 g/mol or less, preferably 4000 g/mol or less and can have a Mn of 3000 g/mol or less, 2000 g/mol or less, 1500 g/mol or less, and even 1200 g/mol or less.

The resulting dispersant can and generally does have a rather broad molecular weight distribution. The reaction product can include unreacted glycidyl ether and amines with varying numbers of reactive hydrogens having been reacted with glycidyl ether. The dispersant of the present invention desirably has a weight-average molecular weight (Mw) of 1500 g/mol or higher, preferably 2000 g/mol or higher and can be 2500 g/mol or higher, 3000 g/mol or higher, 4000 g/mol or higher, 5000 g/mol or higher, 6000 g/mol or higher, 7000 g/mol or higher, 8000 g/mol or higher and even 9000 g/mole or higher while at the same time the dispersant Mw is typically 10,000 g/mol or lower, and can be 9,000 g/mol or less, 8,000 g/mol or less, 7000 g/mol or less, 6,000 g/mol or less, 5,000 g/mol or less, 4,000 g/mol or less or even 3,000 g/mol or less. The dispersant can have any combination of these Mw values while having any combination of the aforementioned Mn values.

The dispersant is useful as an additive in a lubricant where the lubricant comprises a base oil and the dispersant. The dispersant is compatible with the base oil by selecting the R functionality of the glycidyl ether as discussed above. The dispersant is particularly beneficial for lubricants where the base oil comprises or consists of polyethylene glycol, in which case R in the glycidyl ether structure is selected from polyalkylene glycol groups.

The dispersant allows for a method for increasing soot dispersibility in lubricating fluid, the method comprising adding to the lubricating fluid the dispersant of the present invention. One particularly valuable form of this method is characterized by the lubricating fluid comprising a polyalkylene glycol and where R in the glycidyl ether structure of the dispersant reactant is selected from polyalkylene glycol groups as described above.

The concentration of dispersant in the lubricant for both lubricant and method aspects of the present invention is typically 0.1 weight-percent (wt %) or more, preferably 0.5 wt % or more and can be one wt % or more, two wt % or more, three wt % or more, four wt % or more, five wt % or more, six wt % or more, seven wt % or more, eight wt % or more, nine wt % or more and even 10 wt % or more while at the same time is typically 20 wt % or less, preferably 18 wt % or less, still more preferably 15 wt % or less, 12 wt % or less, 10 wt % or less and can be eight wt % or less, seven wt % or less, six wt % or less and even five wt % or less based on total weight of lubricant and dispersant.

EXAMPLES

Synthesis of Glycidyl Ethers

Glycidyl Ether of Polypropylene Glycol Methyl Ether ("GE1")

Charge a 1000 milliliter (mL) round bottom flask with overhead stirring with 407.8 grams (g) of 1000 g/mol polypropylene glycol methyl ether (from Aldrich, number average molecular weight of 1130 g/mol and Mw of 1170 g/mol) and 0.6 g of boron trifluoride diethyl etherate. Warm the solution to 70° C. and begin dropwise addition of 41.10 g (1.1 molar equivalents) of epichlorohydrin. The maximum temperature reached during reaction is 75° C. Stir overnight at 70° C. and then dilute the black solution with 53.2 mL of 50 wt % aqueous sodium hydroxide solution. The organic phase turns brown. Heat overnight at 70° C. and then cool to ambient temperature (approximately 23-25° C.). Remove the lower aqueous phase. Wash the organic phase with 62.5 g of water containing 17.8 g of sodium chloride. Treat the solution with 5 g of magnesium sulfate, filter, and concentrate the clear filtrate on a rotary evaporator to obtain a residue of 403 g of clear solution Glycidyl Ether of UCON™ LB-525 ("GE2")

Charge a 1000 milliliter (mL) round bottom flask with overhead stirring with 575.2 grams (g) of UCON™ LB-525 polypropylene glycol butyl ether (UCON is a trademark of Union Carbide Corporation) and warmed to 60° C. with a nitrogen purge. Add 0.6 g of boron trifluoride diethyl etherate and then 40.6 g of epichlorohydrin dropwise from an addition funnel. The light colored solution becomes black in color after stirring overnight at 60° C. Add 52.2 g of 50 wt % aqueous sodium hydroxide, which lightens the color of solution and generates a precipitate. Stir the mixture overnight at 60° C. and then cool to ambient temperature (23-25° C.). Filter to obtain 556.9 g of light colored solution.

Glycidyl Ether of UCON™ LB-165 in UCON (GE3")

Charge a 1000 milliliter (mL) round bottom flask with overhead stirring with 594.6 grams (g) of UCON™ LB-165 alpha-butyl-omega-hydroxypoly(oxy(methyl-1,2,-ethanediyl)) (UCON is a trademark of Union Carbide Corporation) and warmed to 60° C. with a nitrogen purge. Add 0.84 g of boron trifluoride diethyl etherate and then 37.0 g of epichlorohydrin dropwise from an addition funnel. The light colored solution becomes black in color after stirring overnight at 65° C. Add 48.2 g of 50 wt % aqueous sodium hydroxide, which lightens the color of solution and generates a precipitate. Stir the mixture overnight at 65° C. and then cool to ambient temperature (23-25° C.). Add 3.45 g of 855 phosphoric acid in water. To the slurry add approximately 20 g of anhydrous magnesium sulfate and filter to obtain 567.5 g of light colored solution.

Dispersant Preparation

Example 1—GE1 Product with Aminoethylpiperazine (AEP)

Charge a 500 mL round bottom flask with magnetic stirring and water cooled condenser with 37.55 g of GE1, 65.3 g of methanol and 1.4 g of N-aminoethylpiperazine, or "aminoethylpiperazine"). Heat the solution to reflux overnight and then cool and evaporate on a rotary evaporator to obtain 38.76 g of residue. The residue has a Mn of 1340 g/mol and Mw of 2400 g/mol.

Example 2—GE1 Product with Bis(2-(piperazine-1-yl)ethyl)amine (BPEA)

Charge a 250 mL round bottom flask with magnetic stirring and water cooled condenser with 43.7 g of GE1, 43 g of methanol, and 3.2 g of BPEA. Heat the solution to reflux overnight, then cool and evaporate on a rotoevaporator to obtain 46.9 g of residue. The residue has a Mn of 1860 g/mol and Mw of 3990 g/mol.

Example 3—GE1 Product with 4,4'-methylenebiscyclohexylamine

Charge a 250 mL round bottom flask with magnetic stirring and water cooled condenser with 33.6 g of GE1, 35.9 g of 2-propanol, and 1.74 g of 4,4'-methylenebiscyclohexylamine. Heat the solution to reflux overnight, then cool and evaporate on a rotoevaporator to obtain 34.2 g of residue. The residue has a Mn of 1850 g/mol and Mw of 4400 g/mol.

Example 4—GE1 Product with m-xylenediamine

Charge a 250 mL round bottom flask with magnetic stirring and water cooled condenser with 28.9 g of GE1, 60.1 g of 2-propanol, and 1.00 g of m-xylenediamine. Heat the solution to reflux overnight, then cool and evaporate on a rotoevaporator to obtain 30.1 g of residue. The residue has a Mn of 2100 g/mol and Mw of 3700 g/mol.

Example 5—GE1 Product with Triethylenetetramine

Charge a 250 mL round bottom flask with magnetic stirring and water cooled condenser with 38.3 g of GE1, 77.3 g of 2-propanol, and 0.97 g of triethylenetetramine. Heat the solution to reflux overnight, then cool and evaporate on a rotoevaporator to obtain 38.7 g of residue. The residue has a Mn of 1600 g/mol and Mw of 2900 g/mol.

Example 6—GE1 Product with Diethylenetriamine (DETA)

Charge a 500 mL round bottom flask with magnetic stirring and water cooled condenser with 55.0 g of GE1, 91.0 g of 2-propanol, and 1.14 g of diethylenetriamine. Heat the solution to reflux overnight, then cool and evaporate on a rotoevaporator to obtain 54.5 g of residue. The residue has a Mn of 1630 g/mol and Mw of 3100 g/mol.

Example 7—GE2 Product with DETA

Charge a 250 mL round bottom flask with magnetic stirring and a water cooled condenser with 77.0 g of GE2, 84 g of 2 propanol, and 1.10 g of DETA. Heat the solution to reflux overnight, cool and evaporate on a rotary evaporator to obtain 76.1 g of residue. The residue has a Mn of 2050 g/mol and Mw of 4100 g/mol.

Example 8—5 Mol Equivalent of GE3 Product with DETA

Charge a 500 mL round bottom flask with magnetic stirring and a water cooled condenser with 49.5 g of GE3, 75.7 g of 2-propanol, and 0.68 g of DETA. Heat the solution to reflux overnight, cool and evaporate on a rotary evaporator to obtain 49.5 g of residue. The residue has a Mn of 1400 g/mol and Mw of 2100 g/mol.

Comparative Example A—3 Mol Equivalent of GE3 Product with DETA

Charge a 250-mL round bottom flask with magnetic stirring and a water cooled condenser with 42.3 g of GE3, 43 g of 2-propanol, and 0.97 g of DETA. Heat the solution to reflux overnight, cool and evaporate on a rotary evaporator to obtain 42.4 g of residue. The residue has a Mn of 1380 g/mol and Mw of 1720 g/mol.

Example 9—GE3 and PAG Diglycidyl Ether Product with DETA

Charge a 500 mL round bottom flask with magnetic stirring and water cooled condenser with 11.90 g of 380 molecular weight polypropylene glycol diglycidyl ether, 102.7 g of 2-propanol, and 6.55 g of DETA. Heat the solution to reflux for three hours, cool, and remove 47 wt % of the solution. To the remaining 53 wt % add 151 g of GE3, heat to reflux overnight, cool and evaporate on a rotary evaporator to obtain 155.2 g of residue. The residue has a Mn of 1300 g/mol and Mw of 1720 g/mol.

Example 10—GE1 and PAG Diglycidyl Ether Product with DETA

Charge a 250 mL round bottom flask with magnetic stirring and water cooled condenser with 35.65 g of the portion of solution removed in Example 9's synthesis with 72.4 g of GE1. Heat the solution to reflux overnight, cool and evaporate in a rotary evaporator to obtain 75.8 g of residue. The residue has a Mn of 2180 g/mol and Mw of 3275 g/mol.

Comparative Example B—GE1 Product with Benzylamine

Charge a 250 mL round bottom flask with magnetic stirring and water cooled condenser with 39.4 g of GE1, 72.3 g of 2-propanol, and 2.11 g of benzylamine. Heat the solution to reflux overnight, then cool and evaporate on a rotoevaporator to obtain 40.2 g of residue. The residue has a Mn of 1400 g/mol and Mw of 2600 g/mol.

Comparative Example C—GE1 Product with 1,5-Diaminonaphthalene

Charge a 250 mL round bottom flask with magnetic stirring and water cooled condenser with 36.0 g of GE1, 51.9 g of 2-propanol, and 1.40 g of 1,5-diaminonaphthalene. Heat the solution to 70° C. overnight, then cool and evaporate on a rotoevaporator to obtain 38.7 g of residue. The residue has a Mn of 1670 g/mol and Mw of 2190 g/mol.

Comparative Example D—GE1 Product with Dibenzylamine

Charge a 250 mL round bottom flask with magnetic stirring and water cooled condenser with 31.5 g of GE1, 62.8 g of 2-propanol, and 6.26 g of dibenzylamine. Heat the solution to reflux overnight, then cool and evaporate on a rotoevaporator to obtain 36.9 g of residue. The residue has a Mn of 1120 g/mol and Mw of 1290 g/mol.

Comparative Example E—GE1 Product with 4,4'-Diaminodiphenylmethane

Charge a 250 mL round bottom flask with magnetic stirring and water cooled condenser with 30.3 g of GE1, 71.0 g of 2-propanol, and 1.50 g of 4,4'-diaminodiphenylmethane. Heat the solution to reflux overnight, then cool and evaporate on a rotoevaporator to obtain 31.1 g of residue. The residue has a Mn of 1840 g/mol and Mw of 2880 g/mol.

Comparative Example F—GE1 Product with N,N'-Dibenzylethylenediamine

Charge a 250 mL round bottom flask with magnetic stirring and water cooled condenser with 33.8 g of GE1, 61.9 g of 2-propanol, and 4.06 g of N,N'-dibenzylethylenediamine. Heat the solution to reflux overnight, then cool and evaporate on a rotoevaporator to obtain 37.1 g of residue. The residue has a Mn of 1330 g/mol and Mw of 1940 g/mol.

Comparative Example G—Aminoethylpiperazinepropoxylate

Charge a 250 mL round bottom flask with magnetic stirring, a water cooled condenser, and an addition funnel with 20.30 g (0.157 mol) of AEP (N-aminoethylpiperazine) and 45 g of 2-propanol. To the solution add dropwise 33 g (0.57 mol) of propylene oxide. Stir the solution overnight at ambient temperature, then warm to 45° C. for a few hours using a warm water bath. Use GC analysis to confirmed formation of the AEP tripropoxylate. Evaporate the solution using a rotary evaporator to a residue of 52.5 g of the AEP tripropoxylate (1,1'-((2-(4-(2-hydroxypropyl)piperazin-1-yl)ethyl)azanediyl)bis(propan-2-ol). Charge a 2-L Parr alkoxylation reactor with 21.2 g (0.071 mol) of the AEP tripropoxylate, 30.3 g of 1,2-dimethoxyethane, and 0.68 g (0.01 mol) of 85% powdered potassium hydroxide. After sealing and a nitrogen pressure check, heat the mixture to 140° C. for the addition of 265.4 g (4.6 mol) of propylene oxide at a rate of 1 g/min. After the addition is complete, hold at temperature for 2 hours, then cool and unload into a 1-L round bottom flask. Concentrate on a rotary evaporator at 20 torr with a 50° C. bath temperature to afford 284 g of the AEP polypropoxylate. The product has a Mn of 1500 g/mol and Mw of 2100 g/mol.

Evaluation of Dispersing Capability

Initial dispersing capability is done using carbon black to represent soot. Carbon black is a less expensive and more universally available screening material than actual soot particles and provides a reasonable screening alternative to soot, as shown below.

Prepare oil formulations by combining approximately 1.5 g of the dispersant with 28.5 g of a 95:5 weight ratio mixture of UCON™ LB-165 alpha-butyl-omega-hydroxypoly(oxy (methyl-1,2,-ethanediyl)) and UCON™ LB-285 1-[2-[2-(3-methoxypropoxy)propoxy]ethoxy]butane. Stir the formulation for 15 minutes on a stir plate to obtain a 5 wt % formulation of dispersant in base oil.

Place a 19 mL sample of the formulation into a jacketed graduated cylinder and add approximately 1 g of Columbian Carbon Black Raven 1040 Powder. Subject the mixture to a high shear mixer while cooling the cylinder with water hoses. Manually ramp the mixer from 0 to 17,500 revolutions per minute (rpm) and hold at 17,500 rpm for 15 minutes. Turn off the mixer, stop cooling and remove the cooling hoses. Transfer the mixture to a sample vial.

Measure the viscosity of the mixture using a Reologica Viscoanalyzer controlled stress rheometer using a 4° cone and plate geometry. Conduct all measurements at 40° C. Allow the sample to equilibrate for 300 seconds without pre-shearing. After equilibration, complete a shear sweep from 0.1 to 50.87 Pascals in 20 logarithmic increments. Collect a plot of dynamic viscosity as a function of shear stress.

Little or no change in dynamic viscosity as a function of shear stress reveals that the dispersant is effectively dispersing the carbon black. A large change (decrease) in dynamic viscosity as shear stress is reduced reveals that the dispersant is not effectively dispersing the carbon black.

Effect of Choice of Amine

Each of Examples 1-6 demonstrates less than 20 centi-Poise (0.2 order of magnitude) change in dynamic viscosity over the shear sweep range. This reveals that each of the Examples 1-6 dispersants effectively disperse carbon black in the oil formulation.

In contrast, each of comparative Examples B-F demonstrates 6 or more orders of magnitude change in dynamic viscosity over the shear sweep range. This reveals that these dispersants do not effectively disperse carbon black in the oil formulation.

Each of Examples 1-6 and Comparative Examples B-F has the same glycidyl ether reactant, a full molar equivalent ratio of the glycidyl ether and the only difference is the choice in amine. A comparison of these dispersants reveals the importance and surprising result of the amines suitable for use in the present invention.

Effect of Glycidyl Ether (i.e., a Beta Hydroxyl Group)

The DETA amine was shown to be an effective amine choice in Example 6. To explore the importance of glycidyl ether, different dispersants were made from DETA. Each of the Examples are dispersants made with a glycidyl ether and which then had a beta hydroxyl group, were effective dispersants.

A material (Comparative Example G) of comparable molecular weight that was made similar to Example 1 except having a beta methyl group instead of a beta hydroxyl group in order to explore the importance of the beta hydroxyl group. Comparative Example G demonstrates nearly three order of magnitude change in dynamic viscosity over the shear sweep range in the dispersibility evaluation while Example 1 demonstrates only 0.1 order of magnitude change in dynamic viscosity over the shear sweep range. This data reveals the beta hydroxyl group significantly improves dispersibility capability of the dispersants of the present invention.

Effect of Equivalents of Glycidyl Ether

The effect of reacting at least an equal equivalence of glycidyl ether versus reacting less than an equal equivalence of glycidyl ether reveals that superior dispersibility is achieved when reacting at least an equal equivalence of glycidyl ether.

Example 8 is a dispersant prepared with an equivalent of glycidyl ether. Comparative Example A is a material prepared with less than an equivalent of glycidyl ether (⅗ of an equivalent).

Example 8 demonstrates approximately 0.3 orders of magnitude change in dynamic viscosity over the shear stress sweep of the dispersibility test while Comparative Example A demonstrates approximately two orders of magnitude difference in dynamic viscosity over the shear stress sweep of the dispersibility test. This result reveals that a full equivalent of glycidyl ether results in a material that is significantly better at dispersing carbon black than a material prepared with less than a full equivalent of glycidyl ether.

Evaluation of Ability to Disperse Actual Soot

In order to confirm that the dispersibility evident with carbon black correlates to soot, Examples 1 and 8 were tested with diesel particulate generator (DPG) soot in like manner as described above for the carbon black testing except DPG soot was used instead of carbon black and testing was carried out at two temperatures: 40° C. and 100° C. The higher temperature more closely characterizes actual operating conditions for an internal combustion engine lubricant.

Both of the dispersants, at both temperatures, demonstrated within 0.3 order of magnitude change in dynamic viscosity over the shear sweep range of the test thereby confirming the exceptional dispersing capability of the materials of the present invention for soot in combustion engine lubricants.

It is expected that the results for carbon black for each of the samples tested herein would have similar results when tested with DPG soot.

The invention claimed is:

1. A dispersant comprising the reaction product of an amine and at least one equivalent of glycidyl ether where the amine is selected from a group consisting of aminoethylpiperazine, bis(2-(piperazin-1-yl)ethyl)amine, 4,4'-methylenebiscyclohexylamine, m-xylenediamine, diethylenetriamine, and triethylenetetramine and where the glycidyl ether has the following structure:

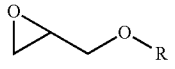

where R is a polyalkylene glycol, the dispersant having a weight-average molecular weight of 2000 grams per mole or higher and 10,000 grams per mole or lower.

2. The dispersant of claim 1, further characterized by the polyalkylene glycol having a number-average molecular weight of 800 grams per mole or higher.

3. The dispersant of claim 1, where R is a poly(propylene glycol) alkyl ether.

4. The dispersant of claim 3, where R is poly(propylene glycol) methyl ether.

5. A lubricant comprising a base oil and the dispersant of claim 1.

6. The lubricant of claim 5, where the base oil comprises a polyalkylene glycol and R in the glycidyl ether structure is selected from polyalkylene glycol groups.

7. A method for increasing soot dispersibility of a lubricating fluid, the method comprising adding to the lubricating fluid the dispersant of claim 1.

8. The method of claim 7, further characterized by the lubricating fluid comprising a polyalkylene glycol and where R in the glycidyl ether structure is selected from polyalkylene glycol groups.

* * * * *